United States Patent [19]

Chiaramonte, Jr.

[11] 4,115,933

[45] Sep. 26, 1978

[54] REMOVABLE SHIELD FOR FOOTWEAR

[76] Inventor: Gasper Chiaramonte, Jr., 229 Court Ave., Lyndhurst, N.J. 07071

[21] Appl. No.: 770,097

[22] Filed: Feb. 18, 1977

[51] Int. Cl.[2] ..... A43B 21/00; A43B 3/24

[52] U.S. Cl. ..... 36/34 B; 36/100

[58] Field of Search ..... 36/34 B, 100, 101, 132, 36/136, 137

[56] References Cited

U.S. PATENT DOCUMENTS

| | | | |
|---|---|---|---|
| 1,849,247 | 3/1932 | Nutt | 36/34 B |
| 2,013,700 | 9/1935 | Savale | 36/100 |
| 2,236,367 | 3/1941 | Gruber | 36/101 |
| 2,767,488 | 10/1956 | Meltzer | 36/34 B |
| 3,263,348 | 8/1966 | Cohen et al. | 36/100 |
| 3,270,442 | 9/1966 | Liebmann et al. | 36/100 |
| 4,020,572 | 5/1977 | Chairamonte | 36/137 |

*Primary Examiner*—Patrick D. Lawson

*Attorney, Agent, or Firm*—William H. Maxwell

[57] ABSTRACT

A replaceable shield, especially to decoratively overlie the platform riser of a shoe, and comprised of a supple laminiform cover having interfacial engagement with the exterior of the shoe by a continuous anchor means at the margins of said cover to releasably engage coextensively thoughout its marginal engagement with the exterior of the shoe.

10 Claims, 6 Drawing Figures

REMOVABLE SHIELD FOR FOOTWEAR

BACKGROUND

Shoes are worn for the practical purpose of protecting one's feet, and for appearance as well. The soles of shoes vary in thickness and the materials thereof present a wide variety of color and texture. There are also specialty shoes and costume footwear that require protection and change in appearance, it being a general object of this invention to provide a shield for the protection of and to enhance the appearance of footwear while being worn by the user.

Shoe coverings are made of leather and plastic sheets and fabrics, the quality and durability of which varies with the purpose and use for which they are intended. For example, the uppers of shoes have been replaceable as by means of removable covers, for both protection and appearance, while the sole and heel portions or platforms of shoes are more utilitarian in nature and covers have not been available therefor. However, elevated platforms are being widely used and the sidewalls thereof afford an exposure than can be decorative and worthy of protection as well as selective changeability. It is to these ends therefore, that I provide a changeable cover for either protection or decoration of the shoe platform.

Heretofore, snaps, buttons, laces and buckles have been employed as the fastening means for securement of shoes and coverings therefor. At the very best, such fasteners are obvious additions to the shoe structure and do not necessarily enhance the designs or appearances thereof. In fact, extra fasteners are most often a detriment and are inherently cumbersome, it being an object of this invention to provide means by which a cover is removably applicable to a shoe without encumbering the same. With this invention, it is the platform which is shown to be protected, although it is to be understood that the means of cover application is also applicable to the uppers of shoes as well as to the platform or sole and heel.

This invention is particularly concerned with novelty shoes for entertainers and the like, such as for example to the ILLUMINATED FOOTWEAR as it is disclosed in my U.S. Pat. No. 4,020,572 issued May 3, 1977 and comprised of a wedge-shaped platform for footwear having an illuminated sole portion operable for high intensity light emmission therefrom. It is an object to provide a decorative cover for this type of novelty shoe, a cover that can be readily applied and/or removed at the will of the wearer. With the present invention, a perimeter anchor seals and attaches the cover, with or without securement by means of snaps or other fasteners.

SUMMARY OF INVENTION

This invention relates to footwear and particularly to selectively replaceable covers to be applied to the platform and/or sole-heel portion thereof. Both the uppers and platforms of shoes are designed for appearance and style, and it is the replaceability of protective and decorative covers with which this invention is concerned. And it is especially a platform cover attachment that is provided for, in a shoe that is extraordinary with respect to said platform, as for example a shoe wherein the platform is illuminated from its interior for spectacular appearance. Also, to protectively cover such a shoe when it is desired to obscure said appearance from view. To these ends I provide one or more continuous anchor means each in the form of a plastic bead engageable in a constricted channel that encompasses the element of the shoe to be protectively enclosed.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
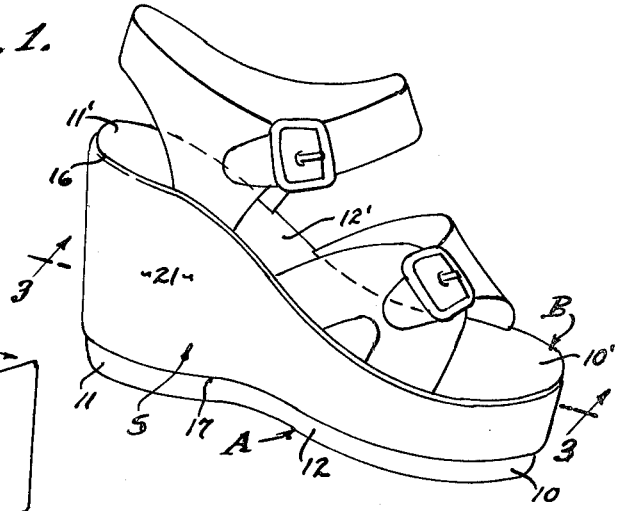
FIG. 1 is a perspective view of a shoe embodying the shield installed in accordance with the present invention.

Referring now to the drawings, a typical wedge-shaped platform sandal is shown and comprised of a platform of shell formation having a sole-heel A and an instep B separated by a riser C. Within the riser C there is an illumination means D, the riser being formed of material, in part at least, to transmit light; however, the said means D is incidental to the present invention although it is usefully employed in conjunction therewith as will become apparent from the following description wherein a removable shield S protectively covers the riser of the shoe. As shown, the sole-heel A and instep B present a raised platform when separated by the riser C, with front toe sections 10 and 10', rear heel sections 11 and 11' and intermediate arch sections 12 and 12'. The said sections of the sole-heel and instep are shaped into simple curvatures of convex and/or concaved forms, and of right and left foot configurations as circumstances require. Characteristically, the shoe platform has continuous upper and lower perimeters disposed in curvilinear planes.

The elements A, B, and C are structural and therefore of substantial heft or thickness, preferably three separate parts made of materials best suited for their functions respectively. Accordingly; the sole-heel element A is made of an opaque leather or rubber like plastic material that is wear resistant and affords frictional contact with a supporting surface; the instep element B is made of an opaque material, like element A, for support of the wearer's foot; and in both instances the material of elements A and B can be non-flexible since the riser C is substantially rigid in form made of a transparent acrylic plastic or the like. In practice, the structural elements A, B and C are injection molded into the configurations shown.

Figure 2:
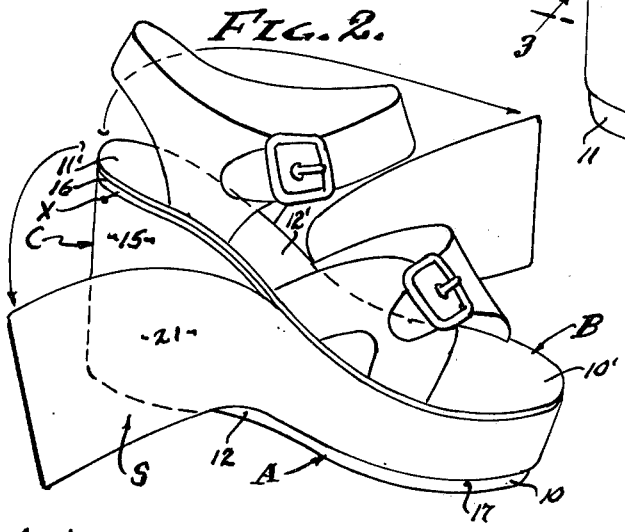
FIG. 2 is a view similar to FIG. 1 illustrating removal of the shield.

Referring now to the shield S and its anchor attachment to the shoe platform at either or both margins thereof, the shoe platform presents an encompassing upstanding curvilinear wall 15 convexly formed at the toe and heel sections and concavely formed at the sides where the arch section of the shoe occurs. As shown, the wall 15 is recurved as it extends throughout the sections of the shoe, and to which the shield S is to be interfacially applied. Further, the plan configuration of the curvilinear plane of the sole-heel A differs considerably from the plan configuration at the curvilinear plane of the instep B; and consequently there is a twisting of the interfacial surface to which the shield S is required to conform. In accordance with this invention, therefore, the shield S is comprised of a flexible body of material, such as leather (real or synthetic) or plastic, and preferably opaque and cut to a flat pattern configuration so as to coextensively and interfacially engage and overlie the wall 15 between the upper and lower margins 16 and 17 thereof. It will be apparent from FIG. 2 how the shield S is removably wrapped around the platform, interfacially engaged against the wall 15 thereof.

Referring now to the anchor means X that I have provided to secure the shield S interfacially and coextensively engaged with the wall 15 of the platform, there is the deformable press-fit of a bead 20 into a restricted channel 30. It is preferred that the bead is formed integrally with the shield body and that the restricted channel is a composite of the sole-heel A and riser C and/or a composite of the instep B and riser C. It is the cooperative formation of the substantially inflexible elements A, B, and C which assemble together so as to establish the said restricted anchor channel or channels 30.

Figure 5:
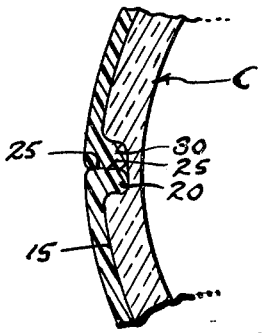
FIG. 5 is an enlarged detailed sectional view taken as indicated by line 5—5 on FIG. 4.
Figure 3:
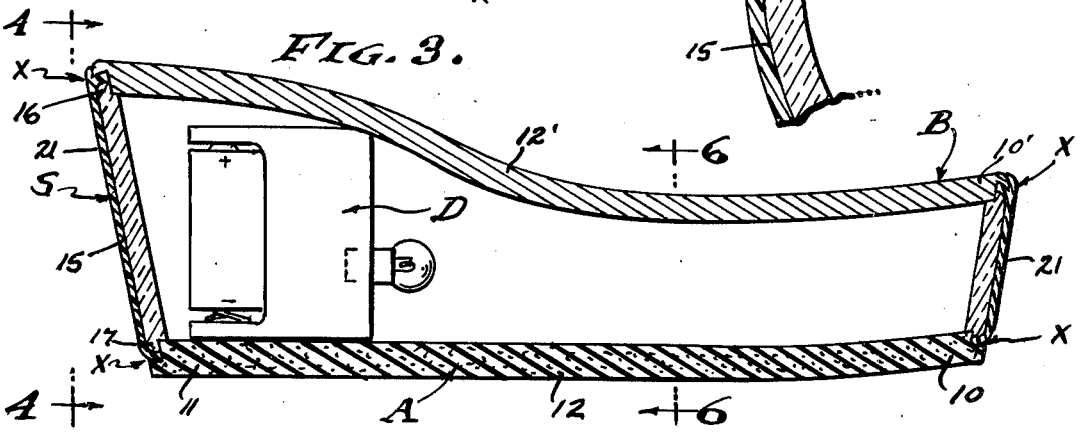
FIG. 3 is an enlarged longitudinal sectional view taken as indicated by line 3—3 on FIG. 1.
Figure 4:
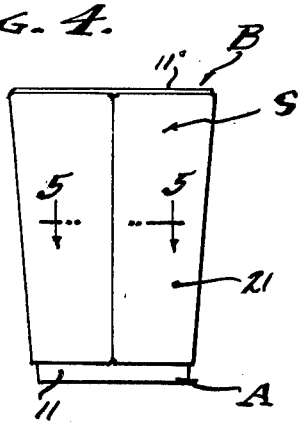
FIG. 4 is a rear view taken as indicated by line 4—4 on FIG. 3.
Figure 6:
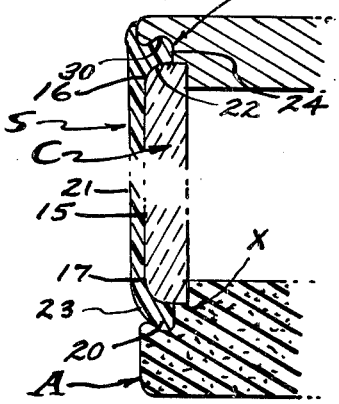
FIG. 6 is an enlarged detailed sectional view taken as indicated by line 6—6 on FIG. 3.

The shield S is preferably an injection molded body 21 of flexible planar configuration having a laterally disposed bead 20 of enlarged or bulbous form coextensive of its periphery. The body 21 is pliable and supple, so as to be twisted and wrapped into interfacial coextensive engagement with the exterior surface of wall 15. As shown, the body 21 is a laminiform of uniform thickness, shaped to coextensively overlie the riser wall 15 between the upper and lower curvilinear planes or margins 16 and 17 thereof. In practice, the upper and/or lower margins of the shield present the male element of the anchor X, preferably a continuous bead 20 of enlarged configuration. Despite the bulbous shape of bead 20, there are no undercuts in the molding thereof, since the inner face 22 is normal to the body plane and preferably a concaved fillet and thereby adapted to be drawn from the core member of a mold. The outer face 23 is divergent with respect to face 22, as it extends laterally and preferably a convex or divergent edge adapted to draw from the cavity member of a mold. The divergent faces 22 and 23 terminate in a common plane joined by a continuously coextensive perimeter wall 24. And, at the upper curvilinear plane there is a lip 26 that substantially overlies the margin 16 (see FIG. 6). Thus, the outer face 23 is outwardly divergent from face 22, so as to present a bulbous head formation throughout the length of the perimeter edge wall 24 that extends between the abutted ends 25 which are opposed as a vertical seam when the shield S is installed (see FIG. 5). In practice, the faces at the abutted ends 25 are normal for flat interface engagement.

A feature of the shield S is the continuous uninterrupted anchor bead 20 that presents the upper and lower perimeters 16 and 17 and opposite abutted ends 25 of the shield body 21.

The anchor means X involves, as the female element thereof, the channel 30 at the upper and lower margins of the platform. In accordance with this invention, the channel 30 is restricted by means of the cooperative relationship of the sole-heel member and the riser C, and/or by means of the cooperative relationship of the instep B with the riser C. The channel 30 can be the same in each instance, a description of one sufficing for both, there being a vertical channel 30' at the heel section of the riser that openly joins the upper and lower channels 30.

Referring now to the riser C, the upper and lower edges thereof are each provided with a face complementary to the bead face 22 above described. And, referring to the sole-heel A and/or to the instep B, these members are each provided with a face complementary to the bead face 23 above described. Intermediate the said complementary faces there is a bottom complementary to the edge 24 above described, all of which continue in the channel 30' to open with continuity into the upper and lower channels 30.

A feature of the anchor channel 30–30' is the uninterrupted continuity thereof in the surface of the wall 15 at and between the marginal edge portions thereof as defined by the curvilinear configuration of the platform numbers A and B.

From the foregoing it will be seen that the flexible shield S is detachable from the shoe platform by the means X of supple material that is deformable sufficiently for the bead 20 to enter and exit the channel 30. In practice, the bead 20 is simply pressed by manipulation into the channel 30, or removed therefrom as circumstances require. With the channels 30 parallel to the curvilinear extremities of the riser C, and with the channel 30' receiving abutting ends 25 of the shield, coextensive covering of the shoe platform is attained with a smooth unobstructed attachment that is readily made or broken as may be desired.

Having described only a typical preferred form and application of my invention, I do not wish to be limited or restricted to the specific details herein set forth, but wish to reserve to myself any modifications or variations that may appear to those skilled in the art.

I claim:

1. The combination of a wearer's shoe having a platform with surrounding upper and lower marginal anchor means of restricted channel configuration, and a replaceable laminiform cover of flexible material adapted to interfacially and conformably surround the exterior of the said platform and with upper and lower marginal beads disengageably secured in the channels of said upper and lower marginal anchor means of the platform.

2. The shoe and replaceable cover combination as set forth in claim 1 wherein the cover beads extend circumferentially and are releasably engaged in the restricted channels complementary thereto in the platform exterior.

3. The shoe and replaceable cover combination as set forth in claim 1 wherein the cover beads are deformable and extend circumferentially and are releasably engaged in the restricted channels complementary thereto in the platform exterior.

4. The shoe and replaceable cover combination as set forth in claim 1 wherein the cover beads are inwardly disposed and continuous with the circumference of the cover and are releasably engaged in the restricted channels complementary thereto in the platform exterior.

5. The shoe and replaceable cover combination as set forth in claim 1 wherein the cover beads are inwardly disposed and deformable and continuous with the circumference of the cover and are releasably engaged in the restricted channels complementary thereto in the platform exterior.

6. The combination of a wearer's shoe having a platform characterized by a riser extending between upper and lower marginal anchor means of restricted channel configuration, and a wrap-around replaceable cover of flexible material with upper and lower edges and abuttable ends and adapted to interfacially conform to the exterior of and coextensively cover the said platform riser and with upper and lower marginal beads disengageably secured in the channel of said upper and lower marginal anchor means of the platform and the abutted ends thereof disengageably secured to the riser therebetween.

7. The shoe and replaceable cover combination as set forth in claim 6 wherein the cover beads extend circumferentially from the upper and lower edges of the cover and are releasably engaged in the restricted channels complementary thereto and extending continuously throughout the upper and lower margins of the platform.

8. The shoe and replaceable cover combination as set forth in claim 6 wherein the cover beads are deformable and extend circumferentially from the upper and lower edges of the cover and are releasably engaged in the restricted channels complementary thereto and extending continuously throughout the upper and lower margins of the platform.

9. The shoe and replaceable cover combination as set forth in claim 6 wherein the cover beads are inwardly disposed and continuous with the upper and lower edges and abuttable ends of the cover and are releasably engaged in the restricted channels complementary thereto and extending continuously throughout and between the upper and lower margins of the platform.

10. The shoe and replaceable cover combination as set forth in claim 6 wherein the cover beads are inwardly disposed and deformable bead continuous with the upper and lower edges and abuttable ends of the cover and are releasably engaged in the restricted channels complementary thereto and extending continuously throughout and between the upper and lower margins of the platform.

* * * * *